US011247803B2

(12) United States Patent
Lichtenberg

(10) Patent No.: US 11,247,803 B2
(45) Date of Patent: Feb. 15, 2022

(54) LABEL APPLICATOR BELLOW SPRAYER

(71) Applicant: Hurst International, LLC, Chatsworth, CA (US)

(72) Inventor: Ari Lichtenberg, Chatsworth, CA (US)

(73) Assignee: HURST INTERNATIONAL, LLC, Chatsworth, CA (US)

( * ) Notice: Subject to any disclaimer, the term of this patent is extended or adjusted under 35 U.S.C. 154(b) by 0 days.

(21) Appl. No.: 17/006,105

(22) Filed: Aug. 28, 2020

(65) Prior Publication Data

US 2021/0078752 A1 Mar. 18, 2021

Related U.S. Application Data

(60) Provisional application No. 62/899,452, filed on Sep. 12, 2019.

(51) Int. Cl.

| | |
|---|---|
| ***B65C 9/28*** | (2006.01) |
| ***B65C 9/18*** | (2006.01) |
| ***B65C 9/00*** | (2006.01) |
| ***B65C 9/40*** | (2006.01) |
| ***B65C 9/04*** | (2006.01) |

(52) U.S. Cl.

CPC ..... *B65C 9/28* (2013.01); *B65C 9/0015* (2013.01); *B65C 9/04* (2013.01); *B65C 9/40* (2013.01); *B65C 2009/0018* (2013.01)

(58) Field of Classification Search

CPC ..... B65C 9/28; B65C 9/0015; B65C 9/40; B65C 9/1884

USPC ..... 156/DIG. 35, DIG. 38

See application file for complete search history.

(56) References Cited

U.S. PATENT DOCUMENTS

| | | | | |
|---|---|---|---|---|
| 8,066,044 | B2 | 11/2011 | Lichtenberg et al. | |
| 2010/0096089 | A1* | 4/2010 | Lichtenberg | B65C 9/26 156/351 |
| 2014/0154370 | A1* | 6/2014 | Wood | A01N 27/00 426/118 |

* cited by examiner

*Primary Examiner* — Mark A Osele
*Assistant Examiner* — Christopher C Caillouet
(74) *Attorney, Agent, or Firm* — Tutunjian & Bitetto, P.C.

(57) ABSTRACT

In accordance with embodiments of the present invention, a produce label applicator machine is retrofitted with a system such that the positive/negative air pressure at the label applicator bellows is configured to introduce and apply a bacteria or maturity inhibiting substance/gas/chemical to the surfaces of the labels as they are being applied to the produce. A source of bacteria or maturity inhibiting substance/gas/chemical is coupled to a fast-acting valve, that is in communication with the air passageway of the label dispensing arms/bellows.

6 Claims, 4 Drawing Sheets

LABEL APPLICATOR BELLOW SPRAYER

BACKGROUND

Field of the Invention

The present invention relates to produce label applicators, and more particularly, it relates to a label applicator for produce that includes a spraying system that enables the spraying of any substance or gas used to either identify the produce being sprayed or bacteria inhibitors, maturity retardants and/or any other substance or gas that is intended to modify the natural maturity of the produce (e.g., increase ethylene resistance) in any way on the label surface either during application of the label or immediately after the label has been applied to the produce.

Related Art

Label applicators for produce are used every day, and an example of such a labeling system can be found in U.S. Pat. No. 8,066,044, incorporated herein by reference.

SUMMARY

According to an implementation, the apparatus for labeling of produce includes a rotating turret section having a plurality of spaced depositor arms each having an air passage way leading to a pre-expanded bellow and a boot tip. A supply of pressurized air is in communication with the air passageway and is configured to selectively deliver pressurized air to each of the depositor arms to provide resistance to boot tip retraction and to provide a positive label application force onto the produce at a surface of the boot tip. A valve device is in communication with the air passageway, and a source of bacteria or maturity inhibiting substance is connected to the valve device. The valve device is configured to selectively introduce the bacteria or maturity inhibiting substance into the air passageway and apply the bacteria or maturity inhibiting substance to a surface of a label either during the application of the label to the produce by the boot tip, or immediately after the application of the label to the produce by the boot tip.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

In order to be able to identify an individual produce item with an application of a coded substance or to increase the longevity or shelf life of produce, a substance, gas or chemical can be sprayed onto the produce. This is generally done in batches where the produce is stacked or contained in a box or carrier for further shipment/processing. As will be appreciated, when produce is stacked or contained in a container of any kind, the ability to evenly apply or spray the entire surface of the produce product with a bacteria inhibiting gas or maturity retardants and/or any other substance or gas that is intended to modify the natural maturity of the produce in any way is hindered, based simply on the fact that one piece may be touching another, and at those points of contact the spray cannot reach the surface of the produce. Additionally, there is no controlled application dosage per item which yields inconsistent results.

As such, it is contemplated herein to use the produce label applicator machine and the positive/negative air pressure at the label applicator bellows to introduce and apply a coded substance or a bacteria inhibiting substance/gas/chemical to the labels as they are being applied to the produce.

Figure 1:
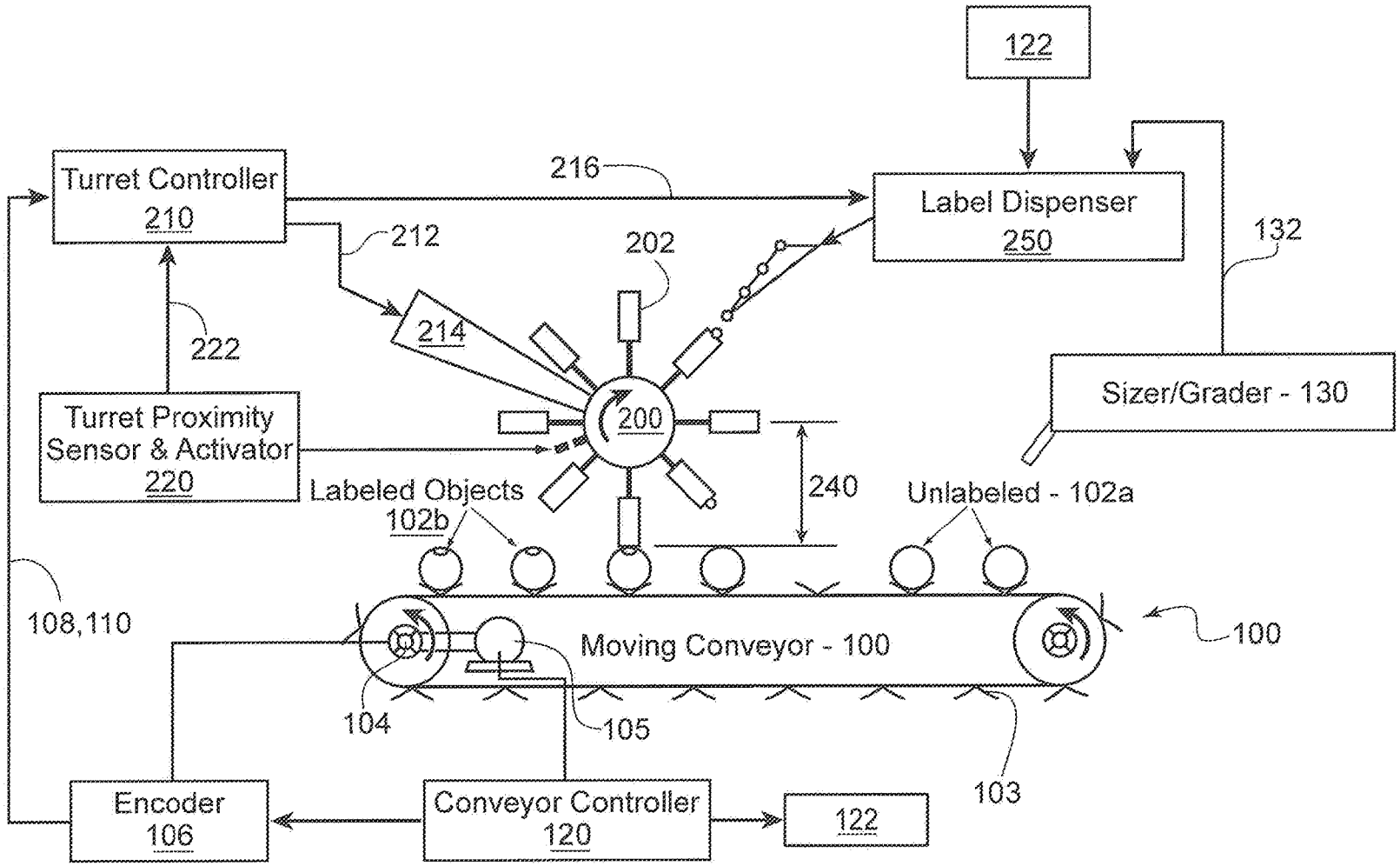
FIG. 1 (Prior Art)
FIG. 1. is a schematic view of components of a high-speed labeling system according to an embodiment of the invention.
Figure 2:
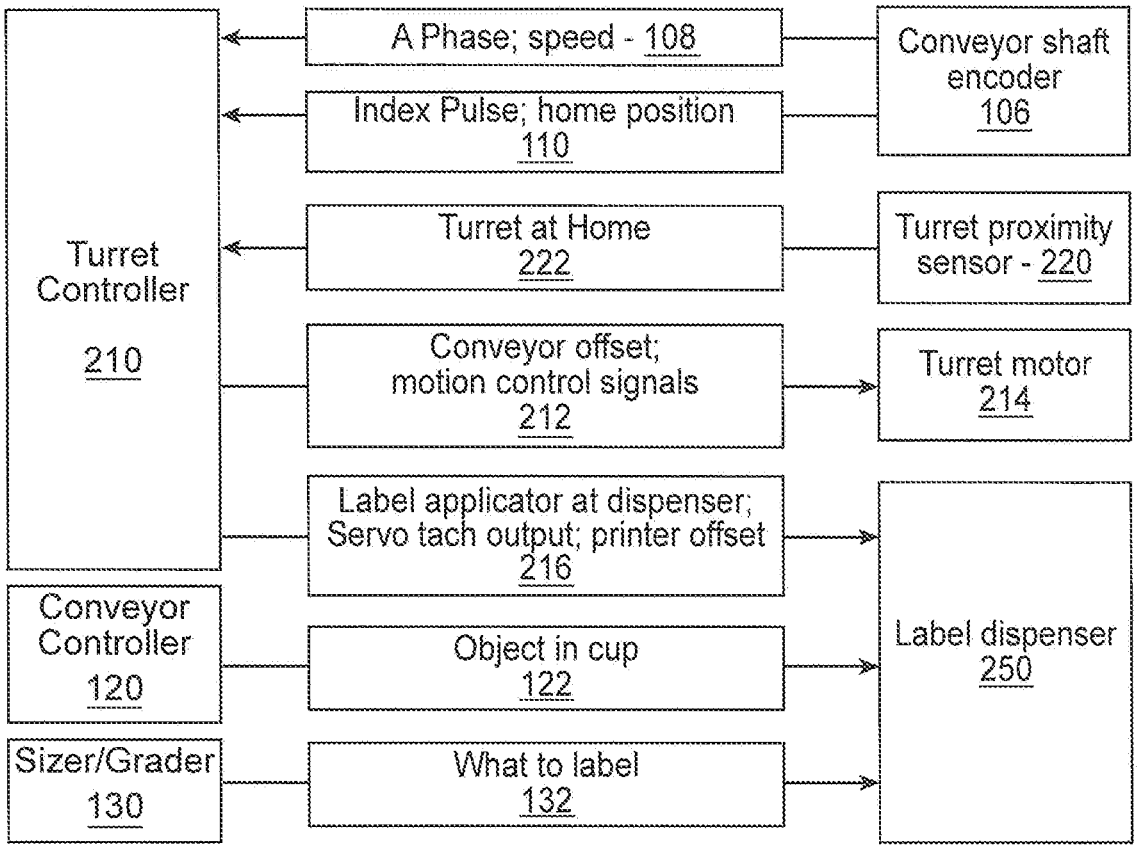
FIG. 2 (Prior Art)
FIG. 2 is a block diagram of signals and paths for the operation of a high-speed labeling system according to an embodiment of the invention.
Figure 3:
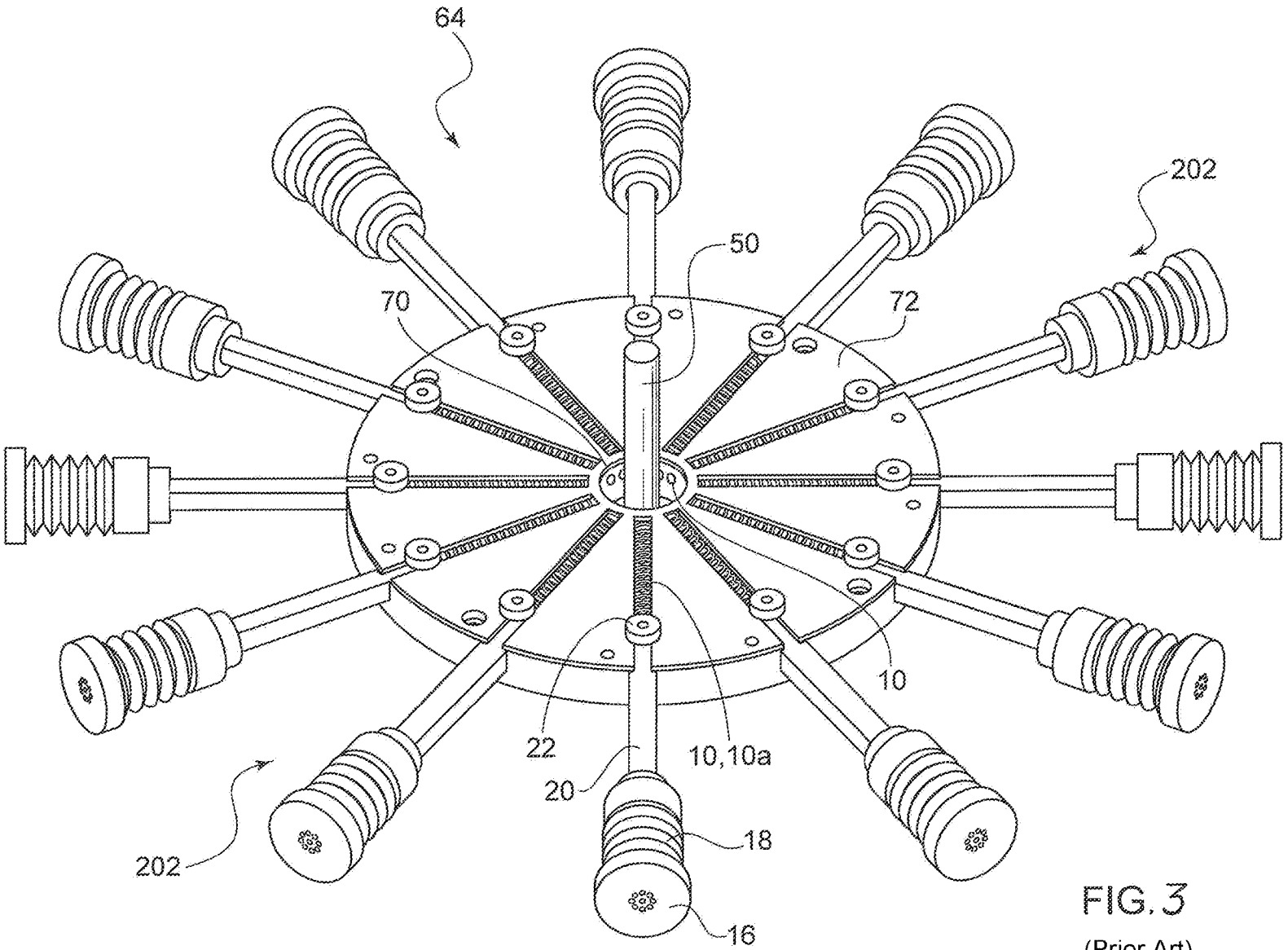
FIG. 3 (Prior Art)
FIG. 3 is a perspective view of a rotating turret section of a high-speed labeling system, according to an embodiment of the invention.

In order to understand this concept a little more clearly, a brief description of the label applicating process is described with respect to FIGS. 1-3.

An overview of the system components, related controllers and signal paths for produce labeling are provided with reference to FIGS. 1 and 2.

A rotating turret 200 is suspended above a moving conveyor 100. Turret 200 includes label depositor arms 202 which pick-up printed labels from label dispenser 250 and adheres the labels on to produce passing below on conveyor 100. A turret controller 210 receives signals from various sensors to control the speed and rotational position of turret 200. The conveyor 100 is illustrated as a single lane. In practical applications, the conveyor is many feet wide and encompasses multiple lanes each having a turret suspended above it. Accordingly, the controller 210 may be configured to operate multiple turrets 200, i.e. one per lane. Alternatively, a master controller may be provided along with multiple slave controllers, each of which controls a single turret 200.

Turret 200 turns in a radial motion from its center and is aligned to accept labels from the label dispenser 250 and deposit them onto unlabeled objects 102*a* moving along conveyor 100. Turret 200 moves synchronously with conveyor 100 so that the speed of a fully extended label depositor arms 202 at radius 240, where the label is applied, matches 1 to 1 with the conveyor's linear speed and therefore the items being carried thereon.

Each label depositor arm 202 is a flexible device designed to accept a label from the label dispenser 250 and apply it to an object 102*a* through contact. One turret 200 may have a number of Label Applicators spaced evenly on the turret. Label depositor arms 202 are also referred to as labeling applicators.

Label Dispenser 250 holds a reel of on-demand printable labels and ejects them at a location close to where the label depositor arms will pass so that they will be picked up via suction by the label depositor arm 202 as it spins past the dispenser 250.

Conveyor 100 is a moving belt or chain link device that moves items to be labeled in a linear motion under the turret 200 and label depositor arms 202. Items on the conveyor 100 are confined to specific locations called cups 103, which are spaced, at consistent intervals along the conveyor.

Conveyor Controller 120 controls the movement of the conveyor 100 and employs sensors to determine presence of objects in the conveyor's cups 103. It generates an Object In Cup signal 122 to indicate if an object is present in a cup at a specific location. When an Object in Cup signal is present, a produce sizer and grader scanner 130 will provide size and grade data in the form of a size and grade signal 132 to determine the type of label which is needed.

Conveyor controller 120 principally operates a conveyor motor 105 coupled to a conveyor shaft 104 which rotates to cause the conveyor 100 to advance. Shaft 104 is designed in such a way that an exact whole number of conveyor cups 103 are advanced per one revolution. In practical applications, a single motor 105 and shaft 104 are utilized to drive all lanes of the conveyor. From a motive perspective, all lanes comprise one large conveyor. However, if the lanes utilize carrier chains, variations from chain to chain can occur.

Turret Proximity Sensor 220 is a position sensor made up of two parts: a sensor mounted in a stationary position; and, an activator (such as a metal pin) mounted to the moving turret 200. Turret proximity sensor 220 is used to determine the home position of the turret.

Turret Controller 210 is a programmable device that is used to process input signals, generate output signals and to control turret motor 214. A description of the signals and signal paths used in applicant's system can be seen in FIG. 2 and are described as follows.

Conveyor shaft encoder 106 is a radial encoder placed on conveyor shaft 104. Conveyor shaft encoder 106 generates two signals, an A Phase signal 108 and an Index Pulse 110, which are used to control the motion of the turret. First, an A Phase signal 108 indicates conveyor motion by evenly pulsing a specified number of times, typically 1000 per revolution of conveyor shaft 104. The A Phase Signal 108 is used by turret controller 210 to synchronize the speed of turret motor 214 to the conveyor speed. Second, an Index Pulse 110 indicates that the conveyor shaft 104 is at its home position by pulsing at an exact shaft position once per revolution. Index pulse 110 is used to indicate where cups 103 are in relation to the conveyor shaft. Index pulse 110 is used by the turret controller 210, as will be described in greater detail below.

A Turret At Home signal 222 indicates that the turret is at position where the stationary Turret Proximity Sensor 220 is lined up with the sensor activator mounted on the Turret. The Turret at Home signal 222 comes from Turret Proximity Sensor and is used by the Turret Controller.

Motion Control Signals 212 are generated by the Turret Controller to move the Turret Motor 214 for homing and label application.

Label Applicator at Dispenser signal 216 indicates that the label applicator is in position to receive a label from the label dispenser. The pulse rate per turret revolution is equal to the number label applicators on the turret. The Label Applicator at Dispenser signal 216 is used by the label dispenser 250 in conjunction with the Object In Cup signal 122 to dispense a label with correct timing for the label applicator to pick up the label. The Label Applicator at Dispenser signal 216 is generated by turret controller 210 and used by label dispenser 250. Signal 216 is also functionally described as a servo tach output, and is utilized in a printer offset function, which will be described in greater detail below.

An Object in Cup signal 122 indicates an object 102*a* is in a cup 103 that will eventually contact a label depositor/applicator arm 202. The Object in Cup signal 122 is used by label dispenser 250 in conjunction with the Label Applicator At Dispenser signal 216 to dispense a label with correct timing for the label depositor arm 202 to pick up the label. The Object in Cup signal 122 is generated by conveyor controller 120 and is used by the label dispenser 250.

A produce sizer and grader scanner 130 is perched above conveyor 100. If there is produce in a cup, label dispenser will need size and grade information in order to print the label. Scanner 130 utilizes object recognition software to generate a size and grade signal 132 which is transmitted to label dispenser 250. Label dispenser 250 uses the size and grade data to direct a search through a look-up table to retrieve the appropriate label graphics.

To accommodate high speed operation the label dispenser 250 needs to accurately know when the label depositor arm 202 is in position to accept a label. To accomplish this, the Turret's position must first be determined by the turret controller 210. This is done by "homing" the Turret. Homing is done by spinning the turret until the turret proximity sensor 220 is lined up with the sensor's activator which activates the Turret At Home signal. Since the sensor 220 is attached to a fixed location on the system's frame and the activator is on the Turret, this Turret At Home signal turns on when the turret is in a specific "Home" location.

To increase the accuracy of this process, the turret 200 is spun at normal speed until the Turret At Home signal 222 is detected. Then the turret is backed up a short distance and then rotated forward again at a much slower rate which increases the accuracy by increasing the number of times the Turret Controller can check for the Turret At Home signal per unit of rotation. When the signal is detected, the Turret is stopped and is considered "Homed".

Once the turret 200 is in the Home location, the turret controller 210 can generate the Label Applicator At Dispenser signal 216 as the turret spins in a way that is consistent in relation to the position of the label depositor arms 202. The turret controller can also offset this signal from the home position to account for differences in the physical locations of the turret proximity sensor 220 relative to the label dispenser 250 due to design or manufacturing variability. This is known as a "Printer Offset". The value of this offset is determined by the user through visual inspection of the position of the labels on the label depositor arm 202 after they are deposited there by the Label Dispenser.

As the conveyor shaft 104 rotates, conveyor encoder 106 translates shaft motion into output pulses on the encoder's A phase signal 108 which represent even increments of motion on the conveyor. The turret controller 210 recognizes these pulses and uses them to drive turret motor 214 in a way that synchronizes the movement of turret 200 so that the speed at the radius 240 at which the label is applied matches 1 to 1 with the conveyor carrying the items onto which the labels are applied.

In addition to maintaining speed with the conveyor 100, turret controller 210 needs to line up the label depositor arms 202 with the conveyor cups 103 while turning. In order to do this, when starting the turret, the turret controller 210 waits until it detects the Index Pulse 110 signal from the conveyor shaft encoder 106 before it starts. Once started the turret controller maintains a count of A Phase pulses 108 and adjusts the Turret's position to match the distance traveled by the conveyor 100. By starting at a specific position of the conveyor's shaft 104 the turret position is consistent relative to the conveyor cups 103. In other words, the Index Pulse signal 110 represents an absolute radial position on conveyor shaft 104. The relationship between that absolute radial position and a cup position is known. The Turret At Home signal 222 represents an absolute radial position of the turret. The relationship between the absolute turret position and a label applicator is known. Therefore, proper sequencing between the Index Pulse 110 and the Turret at Home signal 222 can keep label depositor arms 202 in synchronous motion with cups 103.

To ease stress on the turret motor 105, it is accelerated from a stopped position gradually to a speed slightly faster than the conveyor 100 until it has move the same distance traveled by the conveyor and the conveyor cups 103 and turret 200 are in line. At that time, the speed is reduced to match the A Phase signal.

To adjust for differences between the conveyor cup position and the Index Pulse signal, an offset from the conveyor shaft encoder 106 is used. This offset, called the "conveyor offset", is added to the target position of the turret motor 214 by the turret controller 210 to change the turret position so that when it is synchronized with the conveyor, the label depositor arms 202 line up with the conveyor cups 103. The offset is determined by the operator using visual inspection of where the labels are applied on the objects. The Conveyor Offset signal is logically grouped as part of the motion control signals 212.

The turret 200 contains multiple flexible label depositor arms 202, typically an even number of arms, such as 8 or 12 located around the circumference of such turret. Each flexible label depositor arm 202 has several elements that are crucial to its proper performance and functionality. The flexible label depositor arm 202 is the part of the device that receives the label as it is ejected by the printer/label dispensing unit 250 and then applies it to the product.

The printing/label dispensing unit 250, located over the label depositor arm 202, ejects labels on demand with the adhesive side facing up. The turret 200, which is in constant rotational movement synchronized with the product carrier or conveyor 100 underneath, picks up the ejected labels by means of the multiple flexible label depositor arms 202. Each flexible label depositor arm 202 contains a hollow square shaft 20, which has a cam follower 22 at one end and a bellow holder at the other end. The cam follower 22 rides on the interior wall of a cam that is designed to extend the square shaft outwards from the center of the turret 100 as it rotates toward the 6 o'clock position. As mentioned above, at the other end of the square shaft there is a bellow holder, which holds an extended flexible bellow 18. At the end of the extended bellow 18 there is a removable boot tip 16. The boot tip 16 has a center core that is used both to attach to the bellow and to direct positive and negative air to the surface of the boot tip 16. It is at the surface of the boot tip 16 that the label is received as the printer/dispensing unit ejects it.

At the core of each square shaft 22 there is a rigid tube that directs the positive or negative air from the center air manifold to the bellow holder and in turn to the inside of the extended bellow 18 and subsequently to the surface 16 of the boot tip. The rigid tube is held at one end by a ring located over the air manifold and rotates with the turret. This tube glides in and out of the center of the square shaft as it extends and contracts by the cam profile. This is how the air (both positive and negative) is directed from the center of the turret to the surface of each boot tip.

The negative air (vacuum) is used to pick up the label as it is ejected from the printer/dispensing unit and to hold the label in place at the center of the surface 16 of the boot tip until it is time to be applied onto the surface of the product. At this time the air system switches to positive air and the label is released from the surface of the boot tip. The positive air is not only used to release the label from the boot tip onto the surface of the product, but also to increase resistance to the bellow as it is compressed during the application process. The positive air can be regulated by means of a valve in order to determine the force of resistance necessary to both, release the label from the boot tip, and to increase the downward force of resistance on the extended bellow. The positive air regulation is of particular interest, as it is crucial to the process of releasing the label from the boot tip during the label application on wet surfaces. Likewise, the regulation of bellow compression is necessary to accommodate multiple uses on different products such as those with fragile/sensitive or irregular shaped characteristics.

The extended bellow 18 and removable boot tip 16 combination offers high labeling effectiveness on products with irregular shape, such as bell peppers or avocadoes. The boot tip 16 is made out of a flexible food-grade silicone material design to grab the product at it makes contact with its surface. As the boot tip 16 grabs the surface of the product, the flexible extended bellow 18 moves in the direction that the boot tip 16 dictates following the contour of the product. This design is also useful in situations where the product is traveling off-center from the application axis. As long as the boot tip 16 makes partial contact with the surface of the product, it will force itself to follow the product. The boot tip 16 is also designed to be removed and replaced from the extended bellow 18 for ease of operation and maintenance. As the boot tips 16 are in constant contact with the product, these are exposed to foreign substances and biproducts such as wax or bloom located on the surface of the product. These foreign substances and biproducts will be eventually deposited on the surface and air holes of the boot tips 16. The required grabbing action of the boot tip 16 and the effectiveness of the airflow will be eventually compromised, and they will be required to be cleaned. By having boot tips that are easily replaced, we improve the simplicity of maintenance and system operation.

Another element of the design is that the boot tips 16 could be made from a variety of materials, shapes and surface finishes that could improve the performance of the application in a diverse number of situations. The change of boot tips represents cost effective maintenance and ease of operation, not to mention its valuable versatility.

Vacuum is generated via one or more air pumps generating 150 CFM each. The negative air outlets are connected to one or both ends of the system's frame through a flexible hose and air couplings. This system's frame (aluminum extrusion) also serves as a double air tank/chamber. The top part of the cross member houses the positive air chamber and the bottom part houses the negative air chamber. The vacuum is distributed to each of the labeling lanes via a semi-flexible hose exiting the negative air chamber and connecting to the rear side of each labeling turret. The vacuum is directed to an air manifold located at the rotating center of the turret. The vacuum flows to sections of the turret that require negative air in order to capture labels that are ejected from the printer/dispensing unit above. The section in the turret receiving the vacuum starts at about 11 o'clock (this is the position were the label could potentially be first ejected), and ends at about 5 o'clock (this is the position were the label first makes contact with the product). The vacuum flows from the center of the turret to each of the depositors located around the turret within the section described above by means of rigid plastic tubes inserted in a ring that rotates around the air manifold. These tubes are fitted into square shafts that slide in and out of the turret as the rotate around. Bellow holders are located at the end of each square shaft. These holders hold extended bellows, and at the end of each bellow there is a boot tip. These bellow tips are the ones that hold the labels and make contact with the product to be labeled. The main purpose of this vacuum system is to hold the label from the ejection point to the application area were the boot tip first makes contact with the surface of the product to be labeled. This process needs to be accomplished with high efficiency and low fiction and rotational resistance.

The positive air generated by a central air compressor. The high-pressure air is first connected to a chiller dryer to eliminate most of the moisture in the air. Then the air is passed through an oil filter and a secondary filter/regulator before it is introduced into the labeling system. Once the air is conditioned and filtered, it is connected to the upper section of the aluminum frame as previously described under the vacuum system description. The air is distributed to each of the labeling lanes via a small flexible hose. The air is then split into a two-valve system. The first valve controls the air volume that is directed to the printer/dispensing unit, and the second valve controls the air volume that is directed to the turret. The air directed to the printer/dispensing unit is used to: a) blow away possible dirt accumulated on the label material before it is exposed the print-head, and b) to push down the labels down into the surface of the boot tips as they are being ejected from the printer/dispensing unit. The air directed to the turret is introduced into the air manifold and it used to both: a) blow the label away from the boot tip onto the surface of the product being labeled, and b) to create resistance from the extended below to contract during the process that it is engaged in the application process. The positive air is directed to the boot tips in the same manner as the vacuum. The only difference is that the positive air is directed in the sector of the turret that starts at about 5:30 and ends at about 8 o'clock. This process also needs to be accomplished with high efficiency and low friction as well as effective separation between the negative and positive air chambers within the air manifold. Air contamination between both chambers would render the system incapable of accomplishing the task.

Figure 4:
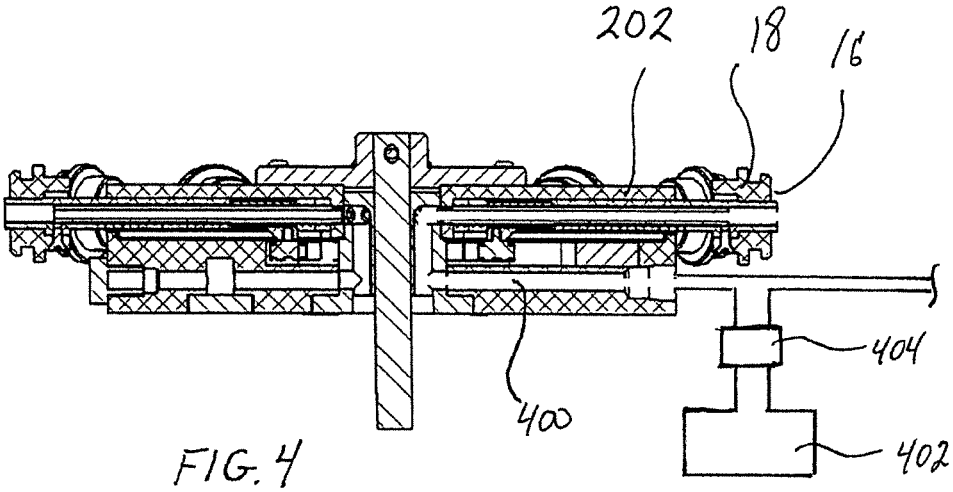
FIG. 4 is a cross sectional view of the rotating turret showing an air passageway to be retrofitted with a bacterium inhibiting gas/chemical supply system according to an embodiment of the invention.
Figure 5:
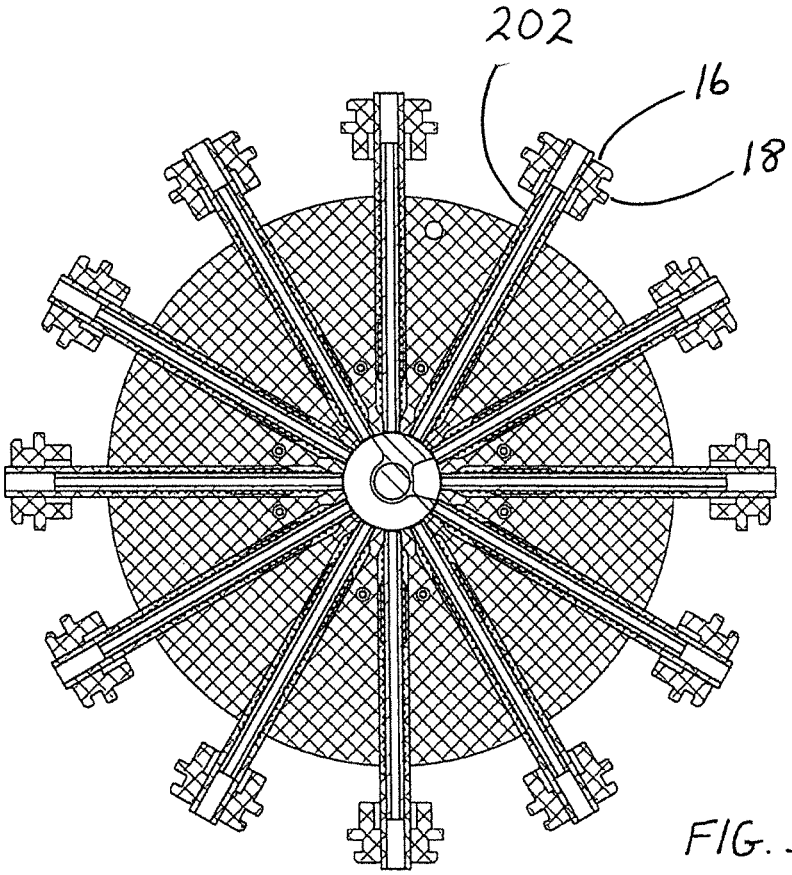
FIG. 5 is top cross-sectional view of the rotating turret showing the air passageway to be retrofitted with a bacteria or bacterium inhibiting gas/chemical supply system according to an embodiment of the invention.

Having read and understood the above operation, FIGS. 4 and 5 show a system where the air passage way 400 for the positive air used to apply the label to the produce can be retrofitted with substance/gas/chemical source 402 and a valve 404 that controls the dispensing of the same into the air passage way 400. Valve 404 is a fast-acting valve, and can be, for example, a pneumatically controlled valve or an electrically controlled valve. The electrically controlled valve could be, for example, a solenoid type valve. In this manner, either a coded substance or a bacteria preventing/maturity inhibiting gas can be deployed through the air passage 400 during a positive air pressure moment of application of the label to the produce via tip 16 of bellow 18. Thus, applying the coded substance or maturity inhibiting substance/gas/chemical to the surface of the label being held by the bellow after and/or during application of the same to produce. In the event of the use of a bacteria/maturity inhibiting substance, the amount and/or concentration of the chemical being applied onto the surface of the label can be regulated based on variables such as processing speed and type of product being treated, and more importantly the intended or anticipated time of travel of the produce from the source to its final remote destination. Thus, it will be apparent that by applying a larger amount will prolong the effect of the applied substance/chemical/gas accordingly. Examples of such bacteria preventing/maturity inhibiting substance/gas/chemicals can be, SMARTFRESH® and HAZEL®. SMARTFRESH® is a registered trademark of AgroFresh, Inc., and includes an active ingredient, 1-methylcyclopropene (1-MCP), which is similar to ethylene, a naturally occurring hormone that causes fruit to ripen. This product interacts with ethylene-sensitive sites in the fruit to manage its response to internal and external ethylene sources. This puts the ripening process "on hold" so that softening and over-ripening occur much more slowly. HAZEL® is a registered trademark of Hazel Technologies LLC, and also includes 1-MCP in a formulation used to increase resistance to ethylene and thus slowing over ripening.

In the embodiment where a coded substance is applied to the surface of the produce for produce identification purposes, this substance can be, for example, an ink that is either visible with the human eye or one that requires a light (e.g., infrared or ultraviolet) to see. In the invisible ink embodiment, the identification code can be applied to the already printed label without interfering with the consumer's ability to read the label or applied directly onto the surface of the produce. In one embodiment, the boot tip could be fitted with a printer like sprayer such that the identification code could include a UPC bar code, a QR Code, or the like. Another coding application could be through the utilization of DNA or nano-particle identifiers introduced into the air passageway as described above.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

In the claims hereof, any element expressed as a means for performing a specified function is intended to encompass any way of performing that function including, for example, a) a combination of circuit elements that performs that function or b) software in any form, including, therefore, firmware, microcode or the like, combined with appropriate circuitry for executing that software to perform the function. The present principles as defined by such claims reside in the fact that the functionalities provided by the various recited means are combined and brought together in the manner which the claims call for. It is thus regarded that any means that can provide those functionalities are equivalent to those shown herein.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. An apparatus for labeling of produce having a rotating turret section including a plurality of spaced depositor arms each having an air passage way leading to a pre-expanded bellow and a boot tip, and a supply of pressurized air in communication with the air passageway to selectively deliver pressurized air to each of the depositor arms to provide resistance to boot tip retraction and to provide a positive label application force onto the produce at a surface of the boot tip, the apparatus comprising:

a valve device in communication with the air passageway; and a source of bacteria or maturity inhibiting substance connected to the valve device, the valve device configured to selectively introduce the bacteria or maturity inhibiting substance into the air passageway and apply the bacteria or maturity inhibiting substance to a surface of a label either during the application of the label to the produce by the boot tip or immediately after the application of the label to the produce by the boot tip.

2. The apparatus of claim 1, where the valve device comprises a fast acting pneumatically or electronically controlled valve device.

3. The apparatus of claim 1, wherein the bacteria or maturity inhibiting substance includes 1-methylcyclopropene.

4. An apparatus for labeling of produce comprising:

a rotating turret section including a plurality of spaced depositor arms each having an air passageway leading to a pre-expanded bellow and a boot tip;

a supply of pressurized air in communication with the air passageway to selectively deliver pressurized air to each of the depositor arms to provide resistance to boot tip retraction and to provide a positive label application force onto the produce at a surface of the boot tip;

a valve device in communication with the air passageway; and a source of bacteria or maturity inhibiting substance connected to the valve device, the valve device configured to selectively introduce the bacteria or maturity inhibiting substance into the air passageway and apply the bacteria or maturity inhibiting substance to a surface of a label either during the application of the label to the produce by the boot tip or immediately after the application of the label to the produce by the boot tip.

5. The apparatus of claim 4, where the valve device comprises a fast acting pneumatically or electronically controlled valve device.

6. The apparatus of claim 4, wherein the bacteria or maturity inhibiting substance includes 1-methylcyclopropene.

* * * * *